US009952539B2

(12) United States Patent
Williams et al.

(10) Patent No.: US 9,952,539 B2
(45) Date of Patent: Apr. 24, 2018

(54) METHOD AND APPARATUS FOR VARIABLE GLOSS REDUCTION

(71) Applicant: ELECTRONICS FOR IMAGING, INC., Foster City, CA (US)

(72) Inventors: Leon Williams, Foster City, CA (US); Thor Olson, Eagan, MN (US)

(73) Assignee: ELECTRONICS FOR IMAGING, INC., Fremont, CA (US)

( * ) Notice: Subject to any disclaimer, the term of this patent is extended or adjusted under 35 U.S.C. 154(b) by 0 days.

(21) Appl. No.: 13/629,298

(22) Filed: Sep. 27, 2012

(65) Prior Publication Data

US 2014/0087079 A1 Mar. 27, 2014

(51) Int. Cl.

| | |
|---|---|
| ***B05D 3/12*** | (2006.01) |
| ***B05C 11/00*** | (2006.01) |
| ***G03G 15/20*** | (2006.01) |

(52) U.S. Cl.

CPC ..... *G03G 15/2053* (2013.01); *G03G 15/2064* (2013.01)

(58) Field of Classification Search

CPC .. B05D 3/12; B05F 9/00; B05C 11/00; D06C 3/00

USPC ..... 427/359

See application file for complete search history.

(56) References Cited

U.S. PATENT DOCUMENTS

| | | | | |
|---|---|---|---|---|
| 4,083,322 A | | 4/1978 | Beckman | |
| 4,258,095 A | * | 3/1981 | Larson | G03G 15/2092 118/115 |
| 4,662,992 A | | 5/1987 | Mirsberger | |
| 5,118,589 A | * | 6/1992 | Aslam et al. | 430/124.13 |
| 5,392,702 A | | 2/1995 | Suzuki et al. | |
| 5,448,339 A | * | 9/1995 | Kokaji | G03G 15/2064 219/216 |
| 5,478,423 A | | 12/1995 | Williamson et al. | |
| 5,493,378 A | * | 2/1996 | Jamzadeh et al. | 399/328 |
| 5,681,494 A | | 10/1997 | Katsuura et al. | |
| 6,164,849 A | | 12/2000 | Koyama | |
| 6,668,152 B1 | | 12/2003 | Jacob | |
| 7,305,198 B2 | * | 12/2007 | Julien | 399/69 |

(Continued)

FOREIGN PATENT DOCUMENTS

| | | |
|---|---|---|
| CN | 1213612 | 8/2005 |
| CN | 101687217 | 3/2010 |

(Continued)

OTHER PUBLICATIONS

Schimitt Industris Inc., Technology Overview, Jul. 25, 2002, http://www.schmitt-ind.com/support-technical-papers-scatter.shtml#intro.*

(Continued)

*Primary Examiner* — Dah-Wei D. Yuan
*Assistant Examiner* — Kristen A Dagenais
(74) *Attorney, Agent, or Firm* — Perkins Coie LLP

(57) ABSTRACT

The smoothness of a toner layer is reduced and thus the gloss of a resulting print is reduced. A single toner, the original high gloss version, is enabled to print all images. A finishing option is provided which, through application of a combination of heat and pressure with a textured roller, reduces the specular gloss of the toner surface by imprinting a high frequency texture onto the smooth toner layer. By adjusting the temperature/pressure of the textured roller, the effective gloss of the press can be adjusted through software as desired.

13 Claims, 8 Drawing Sheets

(56) References Cited

U.S. PATENT DOCUMENTS

| | | | | |
|---|---|---|---|---|
| 8,195,056 | B2 | 6/2012 | Misawa | |
| 8,623,140 | B2 | 1/2014 | Yapel | |
| 8,730,285 | B2 | 5/2014 | Aoki et al. | |
| 2003/0099007 | A1* | 5/2003 | Towner | G03G 15/00 358/520 |
| 2003/0223792 | A1* | 12/2003 | Chen | G03G 15/6573 399/341 |
| 2004/0070658 | A1 | 4/2004 | Janosky et al. | |
| 2006/0110193 | A1 | 5/2006 | Emmert et al. | |
| 2006/0115306 | A1 | 6/2006 | Lofthus et al. | |
| 2007/0071474 | A1 | 3/2007 | Watanabe et al. | |
| 2007/0086803 | A1 | 4/2007 | Kimura et al. | |
| 2007/0217819 | A1 | 9/2007 | Sone et al. | |
| 2008/0000744 | A1 | 1/2008 | Yasumoto | |
| 2008/0193860 | A1 | 8/2008 | Hains | |
| 2009/0029054 | A1* | 1/2009 | Yapel | B05D 1/40 427/359 |
| 2009/0238594 | A1 | 9/2009 | Barton | |
| 2009/0238616 | A1 | 9/2009 | Ciaschi | |
| 2010/0322684 | A1 | 12/2010 | Kikuchi et al. | |
| 2011/0194867 | A1 | 8/2011 | Mills, III et al. | |
| 2012/0155939 | A1* | 6/2012 | Fukatsu et al. | 399/341 |
| 2013/0129932 | A1 | 5/2013 | Pickering et al. | |

FOREIGN PATENT DOCUMENTS

| | | | |
|---|---|---|---|
| CN | 102236313 | | 11/2011 |
| EP | 2713223 | A2 | 4/2014 |
| WO | WO2013032772 | | 3/2013 |
| WO | 2015057848 | A1 | 4/2015 |

OTHER PUBLICATIONS

Schimitt Industries Inc., Technology Overview, Jul. 25, 2002, http://www.schmitt-ind.com/support-technical-papers-scatter.shtml#intro.*

* cited by examiner

METHOD AND APPARATUS FOR VARIABLE GLOSS REDUCTION

BACKGROUND OF THE INVENTION

Technical Field

The invention relates to printing. More particularly, the invention relates to a method and apparatus for variable gloss reduction.

Description of the Background Art

Currently, many of the toner based print engines suffer from a limitation in that they produce glossy images as a result of the inherent toner properties and fusing process. As the toner pile height increases, the toner must be melted into an almost liquid state for sufficient adherence to paper. The liquid state of the toner results in a very smooth surface for high coverage regions of the page. This smooth surface, in turn, has a high specular reflection that is objectionable in some applications and to some users. Competitive presses, such as those that use offset lithography and those that use, for example, HP Indigo liquid toner, yield a low gloss and therefore have a market advantage.

Some manufactures, including Xerox, attempt to reduce the gloss of the melted toner by changing the toner formulation to solidify in a less smooth form. This suffers from at least the following limitations:

1) There is marginal gloss reduction;

2) The press can only produce two levels of gloss corresponding to which toner formulation is installed;

3) It is expensive and time consuming to switch between toners because the machine must be set up differently and all toner of one type extracted before the other formulation is installed; and 4) The two different toner formulations must be stocked in the supply chain.

SUMMARY OF THE INVENTION

Embodiments of the invention provide a method and apparatus for reducing the smoothness of a toner layer and thus reduce the gloss of a resulting print. The invention overcomes the above-mentioned limitations of the state of the art by enabling a single toner formulation, the original high gloss version, to print all images. A new finishing option is required which, through application of a combination of heat and pressure with a textured roller, reduces the specular gloss of the toner surface by imprinting a high frequency texture onto the smooth toner layer. By adjusting the temperature/pressure of the textured roller, the effective gloss of the press can be adjusted through software as desired.

DETAILED DESCRIPTION OF THE INVENTION

Embodiments of the invention provide a method and apparatus for reducing the smoothness of a toner layer and thus reduce the gloss of a resulting print. The invention overcomes the above-mentioned limitations of the state of the art by enabling a single toner, the original high gloss version, to print all images. A new finishing option is required which, through application of a combination of heat and pressure with a textured roller, reduces the specular gloss of the toner surface by imprinting a high frequency texture onto the smooth toner layer. By adjusting the temperature/pressure of the textured roller, the effective gloss of the press can be adjusted through software as desired.

Figure 1:
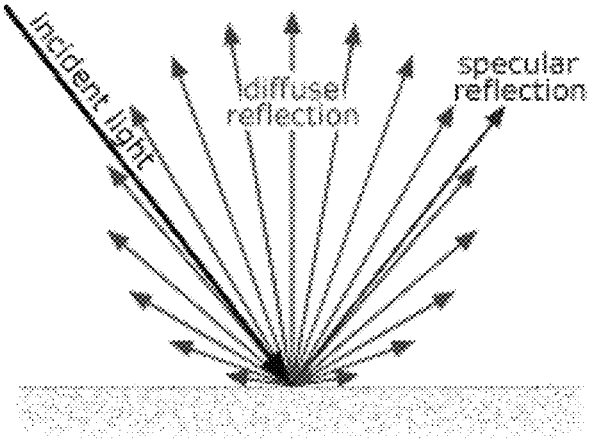
FIGURE 1 (PRIOR ART)
FIG. 1 is a schematic representation of a substrate surface showing incident light, diffuse reflection, and specular reflection.

Gloss is an optical property describing the ability of a surface to reflect light into the specular direction. The smoothness of the surface determines the amount of specular reflection. Increasing the roughness of a surface in crease diffuse reflection, and thus reduces the glossiness of the surface. See FIG. 1.

Figure 2:
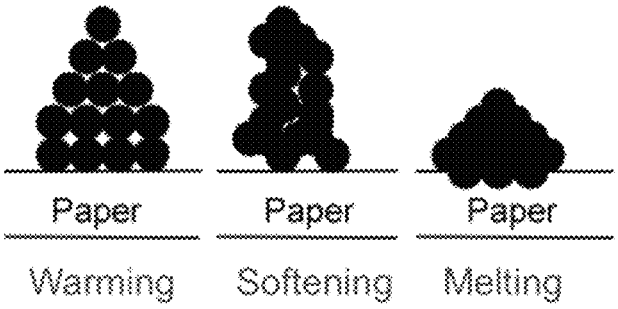
FIGURE 2 (PRIOR ART)
FIG. 2 is a schematic representation of three phases of thermal changes in the toner during the fusing process.

When an image is applied to a substrate, thermal changes in the toner during the fusing process can be divided into three stages (see FIG. 2):

Warming—Increase in temperature of toner particles and paper;

Softening—Melting of the toner starts from the surface of particles and toner particles; and Melting—Partly melted toner adheres to the paper.

Figure 3:
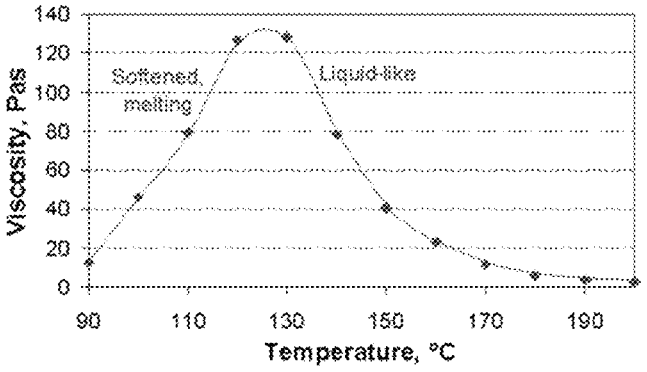
FIGURE 3 (PRIOR ART)
FIG. 3 is a graph that shows viscosity vs. temperature for a toner.

Note that viscosity of toner is a function of temperature. FIG. 3 is a graph that shows viscosity vs. temperature for a toner. This graph was obtained from a published paper at the following link: http://media.tkk.fi/GTTS/GAiF/GAiF_PDF/GAiF2001_3-3.pdf.

Figure 4:
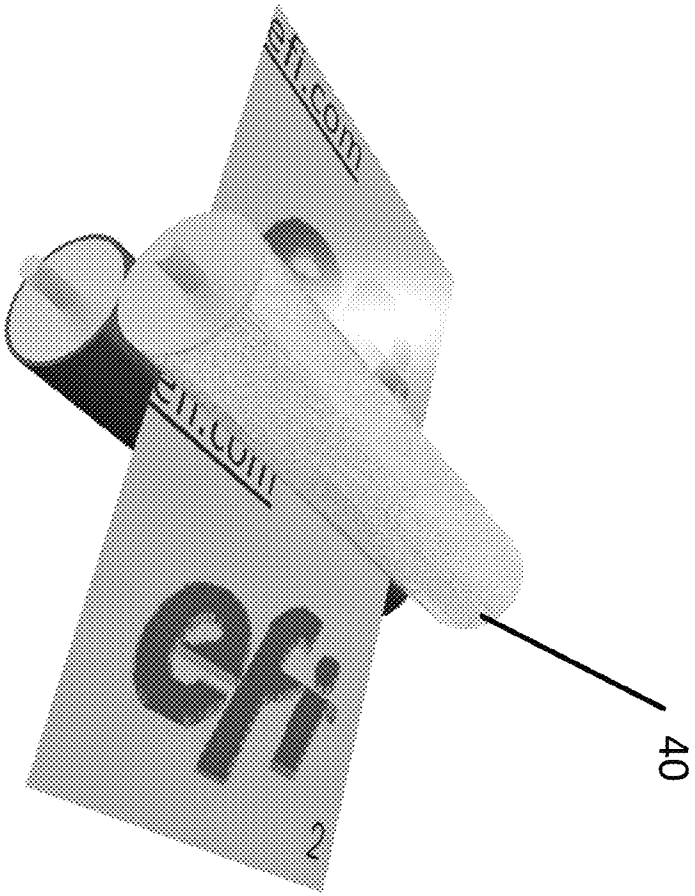
FIG. 4 is a perspective view of a textured roller arrangement according to the invention.

An embodiment of the invention provides a method and apparatus for de-glossing toner that is applied to a substrate surface as follows:

FIG. 4 is a perspective view of a textured roller arrangement according to the invention. To reduce the gloss of a print, the roughness of the toner surface is increased. Increasing the roughness of toner is accomplished with a heated, textured roller 40 and pressure.

The roller can be either solid or a hollow cylinder formed from metal or other rigid surface. The material must be rigid enough to accept and maintain the texture as it presses against the many hundreds of thousands of pages to be de-glossed. The texturing is accomplished by starting with a smooth roller and removing material in the desired pattern. This pattern can be a regularly repeating pattern, such as a screen, or a random pattern of some stochastic nature. One method to apply the texture is applying a photo resist, exposing the resist to light, and chemically etching the material away. Another method is to use a high-powered laser to etch the roller's surface. The amount of gloss reduction can be controlled by adjusting the textured roller's temperature. The roller can be heated to the desired temperature by several means. If an electric resistance coil is used to generate heat, the coil can be positioned inside the roller in direct contact with the surface or outside the roller and blowing air to increase the roller's temperature. Another method is induction heating, where the use of high-frequency switching magnetic fields induces currents in a metal roller to increase its temperature.

A temperature sensor can be employed to measure the roller's surface temperature. A control loop is then used to set the roller to the desired, programmable temperature that results in the desired gloss reduction. This controls how deeply the textured surface can penetrate the toner's surface layer based on the softening and melting point of the toner (see FIG. 5).

In an embodiment, the visibility of the texture is hidden by making the texture at a high frequency, e.g. 150+ line per inch (LPI). Laser etching a steel roller created this texture pattern. The depth of the texturing is limited as the frequency of the texture is increased. At 150 LPI, the depth of the texture is approximately 60 um. This is sufficient to penetrate the 3 to 8 um toner pile height evenly. At 220 LPI, the texture is limited to ~30 um, and at 300 LPI it is further reduced to ~18 um. The texture frequency should be high enough not to be visible, but low enough to enable sufficient depth to penetrate the toner layer smoothly.

Figure 5:
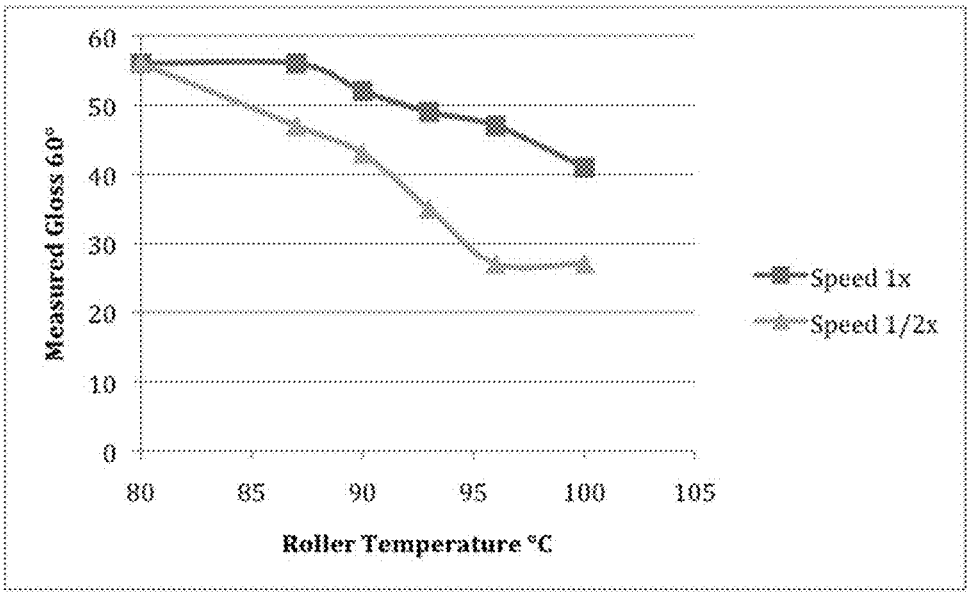
FIG. 5 is a graph that shows testing results with a 150 LPI roller according to the invention.

Initial testing results with a 150 LPI roller are shown in FIG. 5, which is a diagram of actual test results and that shows the gloss, as measured by a gloss checker, vs. the roller temperature. FIG. 5 confirms that, as the roller's nominal temperature is increased, and other variables such as rotational speed and pressure remain the same, the amount of gloss on a page is reduced. The pages before gloss reduction measure at about 55 gloss units (gl). When the roller is at 80 degrees or below, the page after deglossing process remains (for all practical purposes) unchanged. As the roller's temperature is increased, subsequent identical incoming pages of 55 gl are measured after deglossing and are measured with less gloss. The full speed line is running at about 80 pages per minute (PPM). The half speed line is about 40 PPM. The reason the gloss is further reduced from full speed to half speed is that the increased time of contact at half speed enables more energy to be applied to the toner, and thus enables additional softening.

Figure 6:
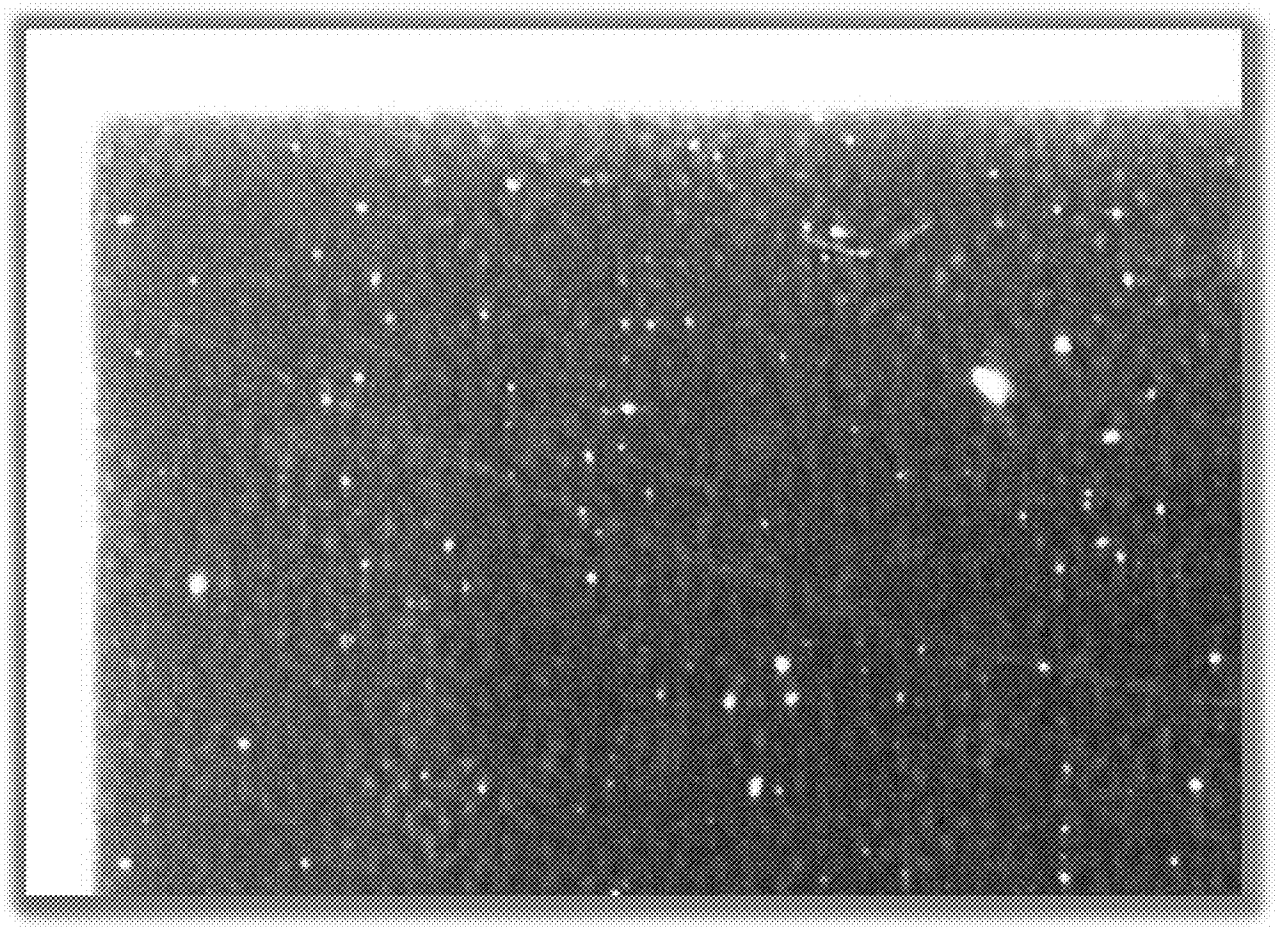
FIG. 6 is a photograph showing a magnified region of a page in which a halftone of the CMYK toner layers is visible.
Figure 7:
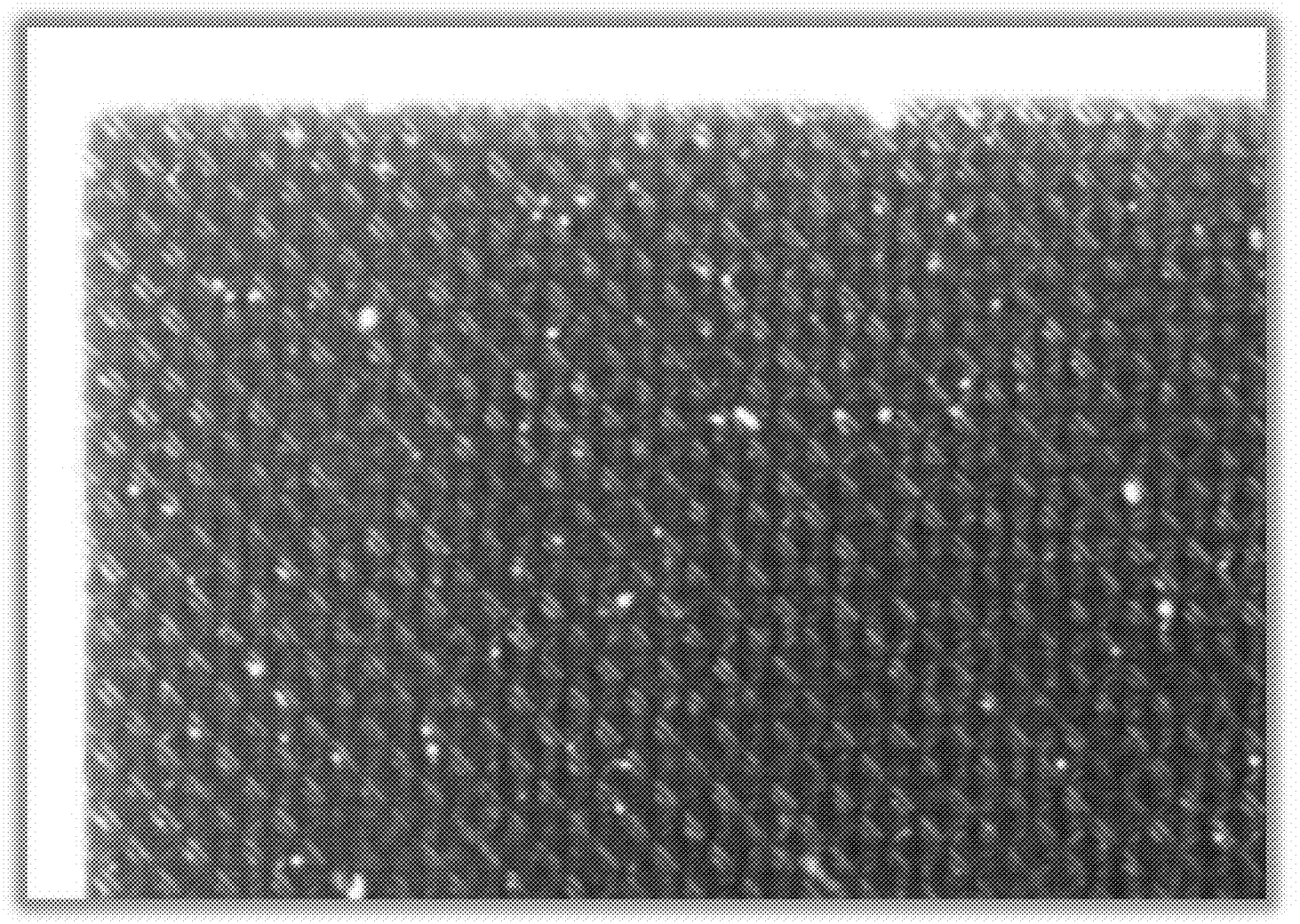
FIG. 7 is a photograph showing the same region of the page of FIG. 6 after de-glossing.

FIG. 6 is a photograph showing a magnified region of a print in which a halftone of the CMYK toner layers is visible. FIG. 7 is a photograph showing the same region of the page shown in FIG. 6 after de-glossing. Notice that the surface now has a diamond pattern visible and that the light reflects differently because the surface of the toner has been changed from flat to textured.

An embodiment of the invention can be used with the Prowler (Xerox Chamonix). Additionally, it can be used with iGen and other toner engines from Ricoh, KM, Canon, and others. This roller can be used inline or offline. For the case of inline, a deglossing finisher unit includes the mechanical components necessary to transport paper from the input to the heated/textured roller and then eject the page at the output. Most digital presses have a standard physical and electrical design to enable multiple finishing options to be configured as needed. For the offline case, stacks of pages previously printed by a press are placed in a sheet feeder. The sheet feeder pulls each page, one at a time, from the top of stack and feeds it to the deglossing finisher, which can be the same design as the inline degloss finisher. At this time, it is anticipated that the roller pressure is not adjusted during a press run other than to cam in or cam out the rollers to enable/disable deglossing on a page by page basis. The pressure is adjusted by springs and/or gas pressure solenoids. The heat is modulated, as described above, using a control loop with resistive or induction heating.

Computer Implementation

Figure 8:
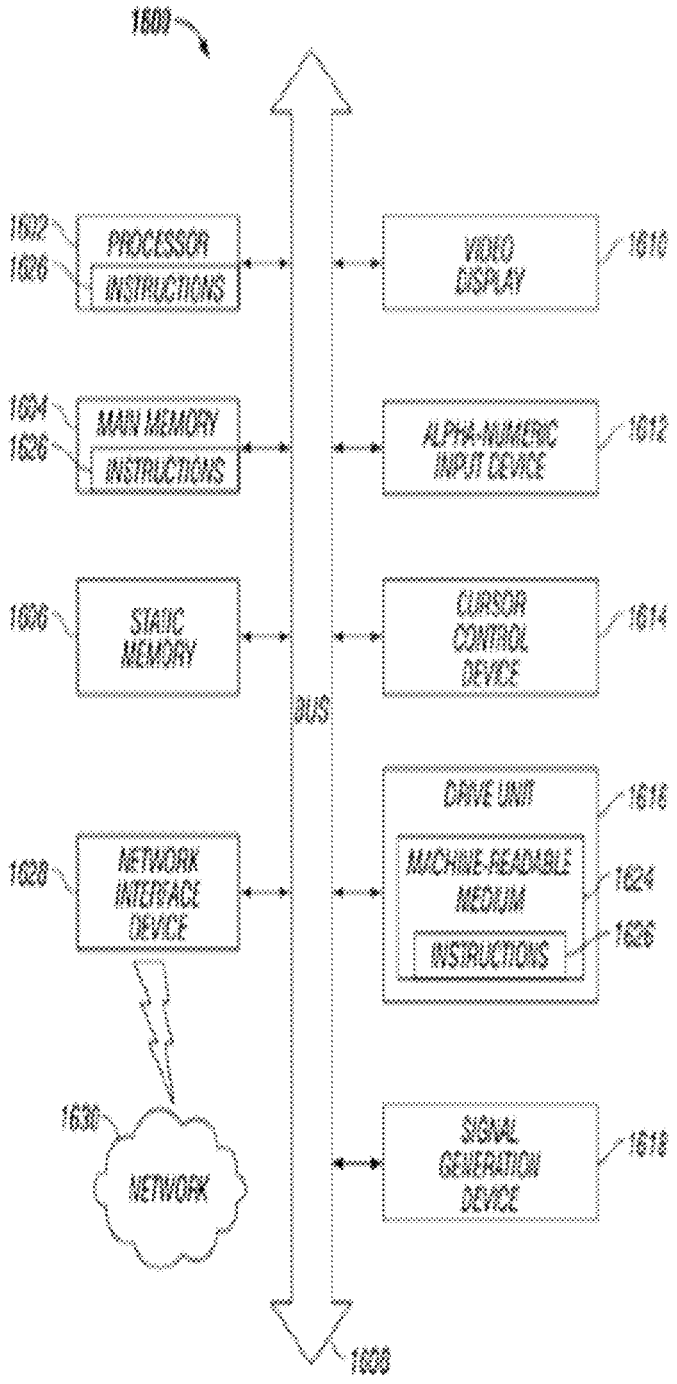
FIG. 8 is a block schematic diagram that depicts a machine in the exemplary form of a computer system within which a set of instructions for causing the machine to perform any of the herein disclosed methodologies may be executed.

FIG. 8 is a block schematic diagram that depicts a machine in the exemplary form of a computer system 1600 within which a set of instructions for causing the machine to perform any of the herein disclosed methodologies may be executed. In alternative embodiments, the machine may comprise or include a network router, a network switch, a network bridge, personal digital assistant (PDA), a cellular telephone, a Web appliance or any machine capable of executing or transmitting a sequence of instructions that specify actions to be taken.

The computer system 1600 includes a processor 1602, a main memory 1604 and a static memory 1606, which communicate with each other via a bus 1608. The computer system 1600 may further include a display unit 1610, for example, a liquid crystal display (LCD) or a cathode ray tube (CRT). The computer system 1600 also includes an alphanumeric input device 1612, for example, a keyboard; a cursor control device 1614, for example, a mouse; a disk drive unit 1616, a signal generation device 1618, for example, a speaker, and a network interface device 1628.

The disk drive unit 1616 includes a machine-readable medium 1624 on which is stored a set of executable instructions, i.e., software, 1626 embodying any one, or all, of the methodologies described herein below. The software 1626 is also shown to reside, completely or at least partially, within the main memory 1604 and/or within the processor 1602. The software 1626 may further be transmitted or received over a network 1630 by means of a network interface device 1628.

In contrast to the system 1600 discussed above, a different embodiment uses logic circuitry instead of computer-executed instructions to implement processing entities. Depending upon the particular requirements of the application in the areas of speed, expense, tooling costs, and the like, this logic may be implemented by constructing an application-specific integrated circuit (ASIC) having thousands of tiny integrated transistors. Such an ASIC may be implemented with CMOS (complementary metal oxide semiconductor), TTL (transistor-transistor logic), VLSI (very large systems integration), or another suitable construction. Other alternatives include a digital signal processing chip (DSP), discrete circuitry (such as resistors, capacitors, diodes, inductors, and transistors), field programmable gate array (FPGA), programmable logic array (PLA), programmable logic device (PLD), and the like.

It is to be understood that embodiments may be used as or to support software programs or software modules executed upon some form of processing core (such as the CPU of a computer) or otherwise implemented or realized upon or within a machine or computer readable medium. A machine-readable medium includes any mechanism for storing or transmitting information in a form readable by a machine, e.g., a computer. For example, a machine readable medium includes read-only memory (ROM); random access memory (RAM); magnetic disk storage media; optical storage media; flash memory devices; electrical, optical, acoustical or other form of propagated signals, for example, carrier waves, infrared signals, digital signals, etc.; or any other type of media suitable for storing or transmitting information.

Although the invention is described herein with reference to the preferred embodiment, one skilled in the art will readily appreciate that other applications may be substituted for those set forth herein without departing from the spirit and scope of the present invention.

For example, embodiments of the invention provide for selective de-glossing of portions of prints. Thus, various creative effects can be achieved, where portions of a print, such as text, are deglossed to varying degrees as desired, while other portions of the print remain glossy. These effects can be achieved at any desired level of granularity, such as page by page in a multipage document, page element by page element within a page, or within a particular page element, for example where a portion of an image is to be highlighted or deemphasized based upon amount of gloss. Further, those skilled in the art will appreciate that the various parameters taught herein for effecting control of gloss can be adjusted as desired alone or in combination. Thus, embodiments of the invention include the use of pressure, heat, chemicals, and combinations thereof to control gloss within a print. The use of heat and pressure is discussed above. With regard to chemicals, any of a number of known chemicals, e.g. solvents and the like, can be used to soften toner applied to the substrate to allow the roller to degloss the image printed on the substrate. Such chemicals can be applied directly to the roller by a spray mechanism or from within the roller via one or more apertures formed through the surface thereof; or a print head or the like may be used to selectively spray a solvent or other chemical on an image or portion thereof formed on a substrate.

Accordingly, the invention should only be limited by the Claims included below.

The invention claimed is:

1. A method for variably deglossing toner that is applied to a substrate to form a printed image, comprising:

receiving, via computer-implemented instructions, a parameter value representing a selectively desired gloss reduction;

forming a texture pattern on a metal roller, wherein the texture pattern is a high frequency texture pattern, and wherein the high frequency pattern is greater than or equal to 150 lines per inch and less than or equal to 300 lines per inch;

measuring, by a temperature sensor communicatively coupled to a control loop, a surface temperature of said metal roller;

based on said measured surface temperature of said metal roller and said parameter value representing said selectively desired gloss reduction, setting, by the control loop the surface temperature of the metal roller to a corresponding programmable temperature thereby controlling the depth that the textured metal roller surface penetrates said toner applied to said substrate based on a softening and melting point of said toner;

responsive to setting the surface temperature of the metal roller to the corresponding programmable temperature; heating the metal roller to the programmable temperature via induction heating, said induction heating using high-frequency switching magnetic fields to induce currents in the metal roller to increase its temperature; and applying heat from said heated metal roller combined with a selected pressure of the heated metal roller to said toner applied to said substrate with said textured metal roller, said pressured textured metal roller imprinting said high frequency texture pattern formed on said roller onto said toner;

thereby resulting in a desired gloss reduction of said printed image.

2. The method of claim 1, further comprising:

applying said selected combination of heat and pressure to said substrate with a textured metal roller to predetermined portions of prints to effect selective gloss reduction of said image.

3. The method of claim 1, wherein said metal roller further comprises any of a solid and a hollow cylinder.

4. The method of claim 1, wherein said metal roller further comprises a metal roller surface which accepts and maintains a texture as it repeatedly presses against pages to be de-glossed.

5. The method of claim 1, wherein texturing of said metal roller is accomplished by starting with a smooth metal roller and removing material in a desired pattern.

6. The method of claim 5, wherein said pattern is any of a regularly repeating pattern and a random pattern of a stochastic nature.

7. The method of claim 1, wherein the amount of gloss reduction is controlled by adjusting the textured metal roller's temperature; and wherein said roller is heated to the desired temperature by any of an electric resistance coil positioned inside the roller in direct contact with the roller surface or positioned outside the metal roller with a blower to circulate heated air to increase the metal roller's temperature; and induction heating in which high-frequency switching magnetic fields induce currents in a metal roller to increase its temperature.

8. The method of claim 1, wherein as the metal roller's nominal temperature is increased, and other variables including rotational speed and pressure remain the same, the amount of gloss on a page is reduced.

9. The method of claim 1, wherein said metal roller is used any of inline and offline;

wherein in inline use, a deglossing finisher unit includes mechanical components necessary to transport paper from an input to said metal roller and then eject a page at the output; and wherein in offline use, stacks of pages previously printed by a press are placed in a sheet feeder, wherein said sheet feeder pulls each page, one at a time, from a top of stack and feeds it to a deglossing finisher.

10. The method of claim 1, wherein metal roller pressure is adjusted during a press run to cam in or cam out the metal roller to enable/disable deglossing on a page by page basis.

11. The method of claim 1, wherein metal roller pressure is adjusted by springs and/or gas pressure solenoids.

12. The method of claim 1, wherein metal roller heat is modulated using a control loop with any of resistive and induction heating.

13. A method for variably deglossing toner that is applied to a substrate to form a printed image, comprising:

receiving, via computer-implemented instructions, a parameter value representing a selectively desired gloss reduction;

forming a texture pattern on a metal roller, wherein the texture pattern is a high frequency texture pattern;

measuring, by a temperature sensor communicatively coupled to a control loop, a surface temperature of said metal roller;

based on said measured surface temperature of said metal roller and said parameter value representing said selectively desired doss reduction, setting, by the control loop the surface temperature of the metal roller to a corresponding programmable temperature thereby controlling the depth that the textured metal roller surface penetrates said toner applied to said substrate based on a softening and melting point of said toner;

responsive to setting the surface temperature of the metal roller to the corresponding programmable temperature; heating the metal roller to the programmable temperature via induction heating, said induction heating using high-frequency switching magnetic fields to induce currents in the metal roller to increase its temperature; and applying a selected combination of heat from said heated metal roller and pressure of the heated metal roller to said toner applied to said substrate with said textured metal roller, said textured metal roller imprinting said high frequency texture pattern formed on said roller onto said toner;

thereby resulting in a desired gloss reduction of said printed image.

* * * * *